United States Patent [19]

Rinz

[11] Patent Number: 4,754,513

[45] Date of Patent: Jul. 5, 1988

[54] PILLOWCASE AND INSERT FOR CONVERTING CONVENTIONAL PILLOW INTO AN ORTHOPEDIC PILLOW

[76] Inventor: Gustave R. Rinz, 340 W. Maplehurst, Ferndale, Mich. 48220

[21] Appl. No.: 930,717

[22] Filed: Nov. 13, 1986

[51] Int. Cl.[4] ..... A47G 9/00

[52] U.S. Cl. ..... 5/490; 5/485; 5/434

[58] Field of Search ..... 5/490, 485, 434, 436, 5/437, 442; D6/601

[56] References Cited

U.S. PATENT DOCUMENTS

| | | | |
|---|---|---|---|
| 395,043 | 12/1888 | Doremus | 5/442 |
| 655,087 | 7/1900 | Jones | 5/436 X |
| 1,020,444 | 3/1912 | Platt | 5/442 X |
| 2,577,595 | 12/1951 | Tobias | 5/436 X |
| 3,602,928 | 9/1971 | Helzer | 5/490 X |
| 3,795,021 | 3/1974 | Moniot | 5/442 X |
| 3,800,340 | 4/1974 | Valentine | 5/485 |
| 3,849,810 | 11/1974 | Degen | 5/442 |
| 4,206,945 | 6/1980 | Kifferstein | 5/434 X |
| 4,274,673 | 6/1981 | Kifferstein | 5/490 X |
| 4,550,459 | 11/1985 | Endel et al. | 5/436 X |

FOREIGN PATENT DOCUMENTS

| | | | |
|---|---|---|---|
| 3138463 | 4/1983 | Fed. Rep. of Germany | 5/442 |
| 16525 | of 1906 | United Kingdom | 5/490 |
| 26072 | of 1909 | United Kingdom | 5/437 |

*Primary Examiner*—Alexander Grosz

*Attorney, Agent, or Firm*—Barnes, Kisselle, Raisch, Choate, Whittemore & Hulbert

[57] ABSTRACT

A pillowcase and insert for converting a conventional pillow into a orthopedic pillow comprising a pillowcase having a pocket secured to the inside of the pillowcase receiving a soft, resilient, elastomeric insert. A conventional pillow is inserted in the pillowcase such that the pillowcase, insert and pillow support the neck and head of the user while lying on a side or in a supine position.

9 Claims, 1 Drawing Sheet

PILLOWCASE AND INSERT FOR CONVERTING CONVENTIONAL PILLOW INTO AN ORTHOPEDIC PILLOW

FIELD OF INVENTION

This invention relates to orthopedic pillows and particularly to a pillow case and insert for converting a conventional pillow into an orthopedic pillow.

BACKGROUND OF INVENTION

Many orthopedic pillows have been developed that prevent and provide relief from morning headache, stiff neck, pain in the back, shoulders and arms, and tension.

Hannouche, U. S. Pat No. 4,525,599, discloses a single piece cervical pillow having a shoulder engaging portion, an occipital engaging portion, and a neck engaging portion therebetween designed to provide continuous support from the shoulder portion to the occipital portion of the user.

However, these one-piece orthopedic pillows are expensive and lack adjustability of the neck engaging portion of this pillow and thus limit the comfort experienced by different users.

Kifferstein, U. S. Pat. No. 4,274,673 discloses a pillow having multiple inserts for use as a headrest, a pillow or cushion while sitting in a chair. This pillow, having multiple inserts, is designed to support the sides of the head of a user while relaxing or sleeping in a cramped chair of a mass transit vehicle. The pillow having multiple inserts prevents the natural tendency of the head of the user to wobble from side to side while attempting to sleep or relax while sitting upright in a chair.

Although this pillow provides comfort for user while sitting in a chair, it does not prevent and provide relief from morning headache, stiff neck and pain in back, shoulder and arms associated with sleeping on a conventional pillow in a supine position.

Furthermore, the prior art pillows are not designed to allow a user to select a pillow suitable to the users preference such as softness, hardness and the like, and still provide orthopedic support of the head and neck of the user.

SUMMARY OF THE INVENTION

Among the objectives of the present invention are to provide a conventional and inexpensive, pillowcase and removable insert for converting a conventional pillow into an orthopedic pillow designed to prevent and provide relief from morning headache, stiff neck and pain in back, shoulder and arms, and tension associated with sleeping on a conventional pillow.

A conventional pillow is inserted in the inventive pillowcase having a partial cylindrical received therein, such that the pillowcase, insert and conventional pillow may be used in combination to form an inexpensive orthopedic pillow that supports the neck and head of the user while lying on a side or in a supine position.

DETAILED DESCRIPTION

DESCRIPTION

Figure 1:
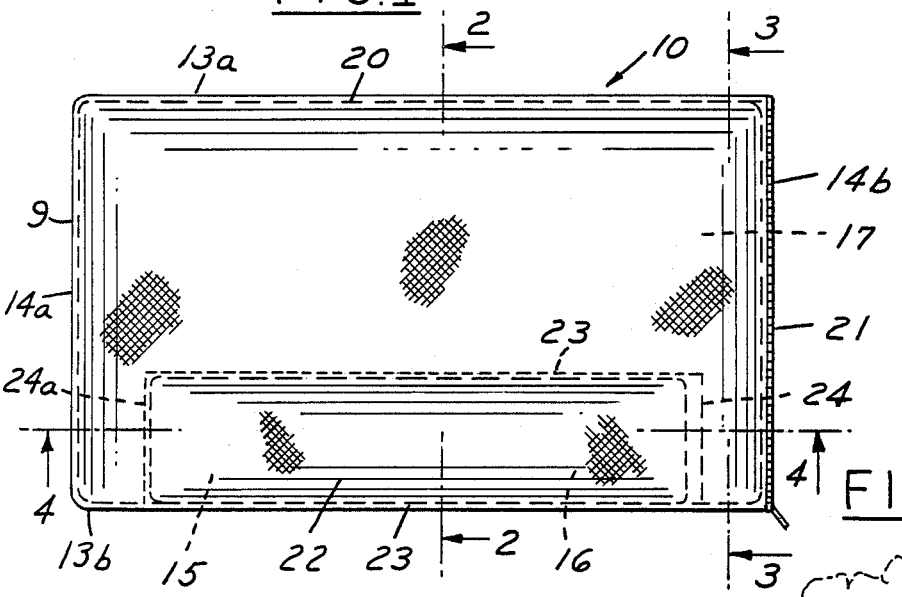
FIG. 1 is a plan view of a pillowcase and pocket embodying the invention.
Figure 5:
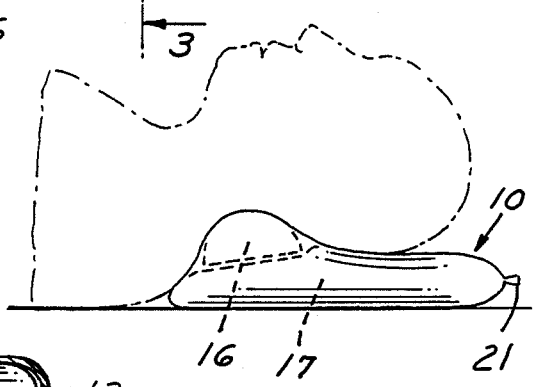
FIG. 5 is a schematic view of the present invention showing the support of the neck and head of a person lying in the supine position.
Figure 2:
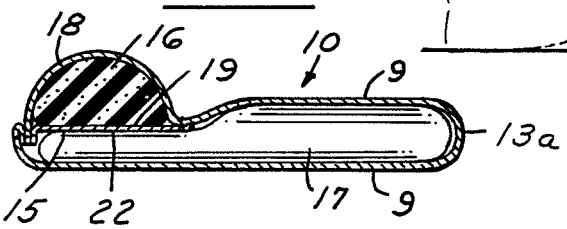
FIG. 2 is a fragmentary sectional view of FIG. 1 taken along line 2—2, with an insert in the pocket.
Figure 3:
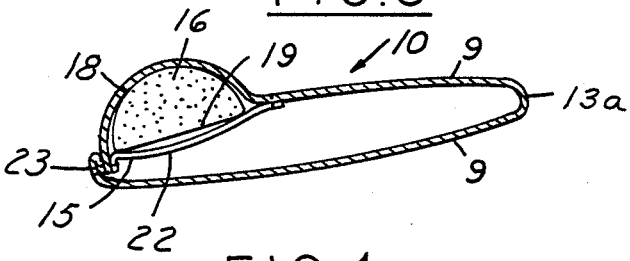
FIG. 3 is a fragmentary sectional view similar to FIG. 2 without the conventional pillow inserted therein.
Figure 4:
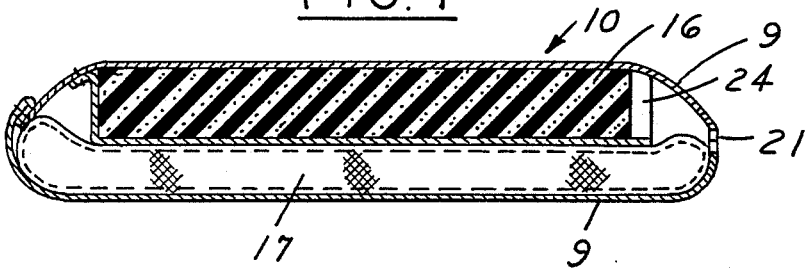
FIG. 4 is a fragmentary sectional view of FIG. 1 taken along line 4—4, with the insert and conventional pillow in place.

Referring to FIG. 1, a pillowcase 10 comprises spaced panels 9 having long and short sides. The panels 9 are joined, as by sewing, along the long sides 13*a*, 13*b* and one short side 14*a*. Alternatively, the pillowcase 10 may comprise a single panel 9, folded on a long side 13*a*, and joined, as by sewing, along the other long side 13*b* and one short side 14. The pillowcase 10 has a pocket 15 formed on the inside of one panel 9, as presently described, for receiving and carrying an insert 16 to be used in combination with a conventional pillow 17. The insert 16 is preferably semi-cylindrical in cross section defining a curved surface 18 facing the panel 9 on which the pocket 15 is formed and a flat side 19. The insert may have a diameter in the range of about 4 inches to 5 inches, and preferably 5 inches, and may have a length in the range of about 17 inches to 19 inches, and preferably 17 inches. Alternatively the insert may be oval in cross section. The insert 16 is made of a soft, resilient, elastomeric material such as polyurethane foam or polyester foam.

The pillowcase 10 is thus substantially rectangular in shape, closed on three sides, specifically its opposite longer sides 13*a*, 13*b* and one of its short sides 14*a*. The pillowcase 10 is open at the other of its short sides 14*b*. The pillowcase 10 may be made from a variety of materials such as soft woven cloth, or films. As in the conventional pillowcase, the width and length of the pillowcase are slightly longer than the conventional pillow it receives. The length and width of the conventional pillow is illustrated by dotted line 20 in FIG. 1. The open side of the pillowcase 10 can be left open but is preferably closed by fasteners that can be opened such as a zipper 21.

The pocket 15 is formed by a flat rectangular panel 22 and has opposed long sides 23 and short sides 24. The panel 22 is secured, as by sewing, to the inside of the pillowcase 10 on its opposite longer sides 23 and on one short side 24*a* furthest from the open side 14*b* of the pillowcase, near and parallel to one of the longer sides 13*a*, 13*b* of the panel 9. The pocket 15 has a length slightly less than the length of the pillowcase 10.

The pocket 15 has a width slightly greater than the width of the flat side 19 of the partial cylindrical insert 16.

The position of the insert 16 can be adjusted by simply rotating the pillowcase 10 having the pocket 15 and insert 16 received therein, about the conventional pillow 17 in accordance with the preferance of the user and thereby prevent and provide relief from morning headache, stiff neck, pain in the back, shoulders, and arms, tension and generally provide for a comfortable, relaxed sleep.

I claim:

1. A pillowcase for converting a conventional pillow into an orthopedic pillow comprising two rectangular panels having opposed long sides and short sides, said panels being joined along three sides and the other of said sides forming an opening for receiving a pillow body, a flat panel having parallel opposed spaced long sides and parallel opposed short sides, said flat panel being attached along its long opposed sides to the inner surface of one of said rectangular panels adjacent one of the long sides thereof, said flat panel being parallel with the other rectangular panel and defining an elongated pocket extending generally parallel to and extending substantially along the entire length of a long side of said rectangular panels, said pocket having at least one end open, an elongated removable insert extending substantially along the entire length of said flat panel and positioned in said pocket, said insert being made of resilient material such that when a pillow is placed in said pillowcase, the insert defines an orthopedic support for the neck and head of a person.

2. The pillowcase set forth in claim 1 wherein said insert which comprises:

a soft, resilient, elastomeric material having a generally semi-cylindrical shape having a cross sectional diameter in the range of about 4 inches to 5 inches, said pillowcase insert having a width and length slightly less than the width and length of said pocket, and said semi-cylindrical insert having a length in the range of about 17 inches to 19 inches.

3. The pillowcase set forth in claim 2 wherein said diameter is about 5 inches and said length is about 17 inches.

4. The pillowcase set forth in claim 1 wherein said flat panel has a length slightly less than the length of the pillowcase.

5. The pillowcase set forth in claim 2 wherein said flat panel has a rectangular shape.

6. The pillowcase set forth in claim 4 wherein said flat panel is fastened to one of the panels of the pillowcase by stitching.

7. The pillowcase set forth in claim 4 wherein said insert is substantially semi-circular in cross section.

8. The pillowcase set forth in claim 1 wherein said insert comprises a body of soft, resilient, elastomeric material.

9. The pillowcase set forth in claim 7 wherein said insert comprises a material selected from the group comprising foamed polyurethane and foamed polyester.

* * * * *